US010737900B2

(12) United States Patent
Kiriyama

(10) Patent No.: US 10,737,900 B2
(45) Date of Patent: Aug. 11, 2020

(54) POST-PROCESSING APPARATUS, IMAGE FORMING SYSTEM, AND CONTROL PROGRAM FOR POST-PROCESSING APPARATUS

(71) Applicant: Konica Minolta, Inc., Tokyo (JP)

(72) Inventor: Tomohiro Kiriyama, Kouhu (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/204,657

(22) Filed: Nov. 29, 2018

(65) Prior Publication Data

US 2019/0193980 A1 Jun. 27, 2019

(30) Foreign Application Priority Data

Dec. 21, 2017 (JP) ..... 2017-245083

(51) Int. Cl.

| | |
|---|---|
| ***B65H 37/04*** | (2006.01) |
| ***B65H 35/00*** | (2006.01) |
| ***G03G 15/00*** | (2006.01) |
| ***G03G 21/16*** | (2006.01) |

(52) U.S. Cl.

CPC ..... *B65H 35/0006* (2013.01); *B65H 37/04* (2013.01); *G03G 15/6523* (2013.01); *G03G 15/6582* (2013.01); *G03G 21/1604* (2013.01); *B65H 2801/27* (2013.01); *G03G 15/502* (2013.01); *G03G 15/6544* (2013.01); *G03G 2221/1696* (2013.01)

(58) Field of Classification Search

CPC ..... G03G 2221/16; G03G 2221/1684; B65H 37/00; B65H 43/00; B65H 2402/40; B65H 2402/60; B65H 2553/20

USPC ..... 270/58.07; 399/110

See application file for complete search history.

(56) References Cited

U.S. PATENT DOCUMENTS

| | | | | |
|---|---|---|---|---|
| 7,419,149 | B2 * | 9/2008 | Oota | B23D 35/008 270/37 |
| 7,832,318 | B2 * | 11/2010 | Oota | B23D 35/008 83/371 |
| 10,273,109 | B2 * | 4/2019 | Oguri | B65H 31/10 |
| 2003/0035143 | A1 * | 2/2003 | Glemser | B23D 35/008 358/1.16 |
| 2003/0036468 | A1 * | 2/2003 | Blank | B23D 35/008 493/8 |

FOREIGN PATENT DOCUMENTS

| | | |
|---|---|---|
| JP | 2005239308 A | 9/2005 |
| JP | 2005239312 A | 9/2005 |

* cited by examiner

*Primary Examiner* — Leslie A Nicholson, III

(74) *Attorney, Agent, or Firm* — Lucas & Mercanti, LLP

(57) ABSTRACT

A post-processing apparatus that performs, by one or more functional units which can be switched one another, predetermined post-processing corresponding to a function of the one or more functional units on a conveyed paper includes: a plurality of slots in which the one or more functional units can be loaded at respective loading positions along a conveyance path; a loading detector that detects that the one or more functional units are loaded in the slots; and a condition output part that outputs a condition that allows the post-processing depending on the loading positions of the slots in which the one or more functional units are loaded.

13 Claims, 16 Drawing Sheets

FIG. 5A

| WHERE TO EJECT | | FUNCTIONAL UNIT | | | | NOTES |
|---|---|---|---|---|---|---|
| DOWNSTREAM POST-PROCESSING APPARATUS | PURGE | SLOT #4 | SLOT #3 | SLOT #2 | SLOT #1 | |
| ○ PAPER LENGTH OF LESS THAN OR EQUAL TO 490mm IS ACCEPTED<br>× LONG LENGTH NOT ACCEPTED | ○ ALL ACCEPTED | DUMMY/ OTHERS | DUMMY/ OTHERS | FD SLIT | CD CUTTING | · TO EJECT DOWNSTREAM PAPER HAVING PAPER LENGTH OF LESS THAN OR EQUAL TO 490mm, IT IS NECESSARY TO ARRANGE CD CUTTING IN SLOT #1 |

FIG. 5B

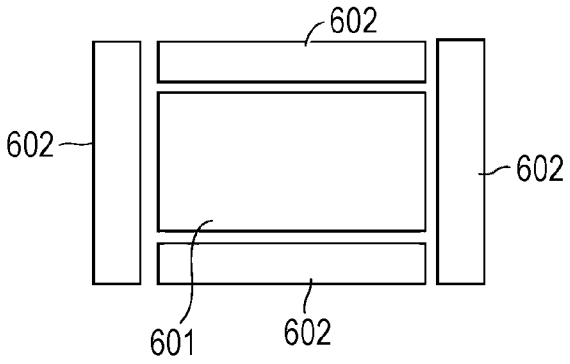

FIG. 6A

| WHERE TO EJECT | | FUNCTIONAL UNIT | | | | NOTES |
|---|---|---|---|---|---|---|
| DOWNSTREAM POST-PROCESSING APPARATUS | PURGE | SLOT #4 | SLOT #3 | SLOT #2 | SLOT #1 | |
| ○ PAPER LENGTH OF LESS THAN OR EQUAL TO 490mm AND LENGTH FROM TOP END TO LAST CREASE POSITION OF LESS THAN OR EQUAL TO 360mm IS ACCEPTED<br>× LONG LENGTH NOT ACCEPTED | ○ ALL ACCEPTED | DUMMY/ OTHERS | FD SLIT | CREASE | CD CUTTING | · TO EJECT DOWNSTREAM PAPER HAVING PAPER LENGTH OF LESS THAN OR EQUAL TO 490mm, IT IS NECESSARY TO ARRANGE CD CUTTING IN SLOT #1 |

FIG. 6B

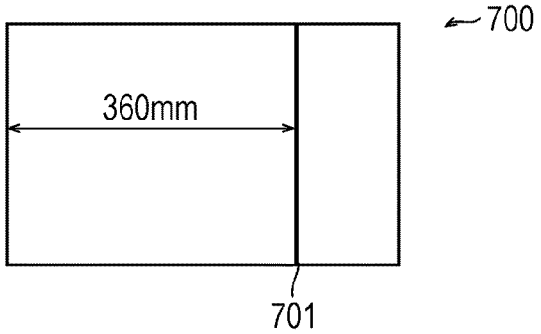

FIG. 6C

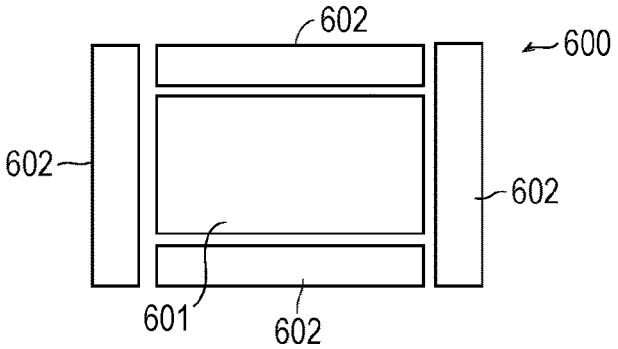

FIG. 6D

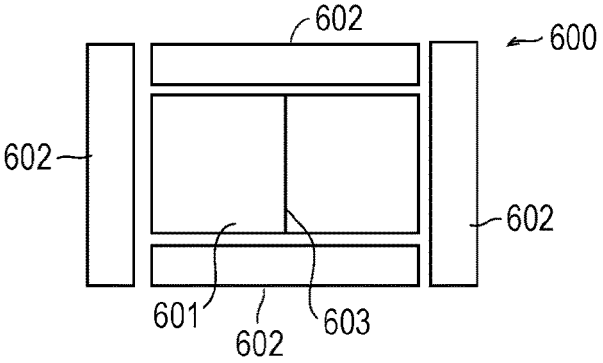

FIG. 7A
| WHERE TO EJECT | | FUNCTIONAL UNIT | | | | NOTES |
|---|---|---|---|---|---|---|
| DOWNSTREAM POST-PROCESSING APPARATUS | PURGE | SLOT #4 | SLOT #3 | SLOT #2 | SLOT #1 | |
| × NOT ACCEPTED (DIVIDED INTO MULTIPLE SHEETS) | ○ ALL ACCEPTED | CD CUTTING | MARGIN CUTTING SLIT | DUMMY/ OTHERS | FD SLIT | · IT IS NECESSARY TO MANUALLY CHANGE WIDTH OF BLADE FOR MARGIN CUTTING |
FIG. 7B
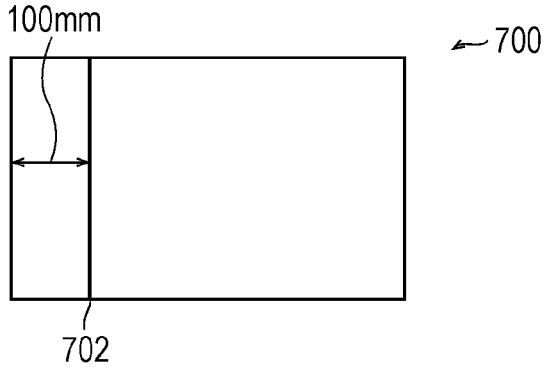
FIG. 7C
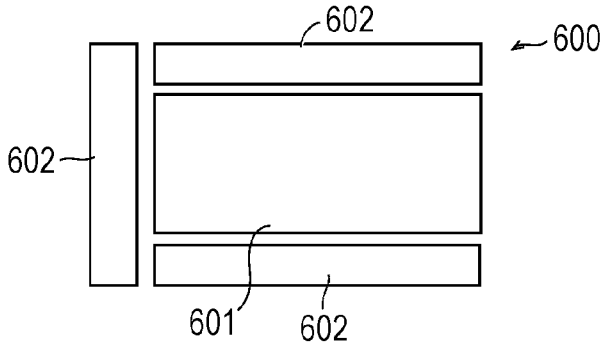
FIG. 7D
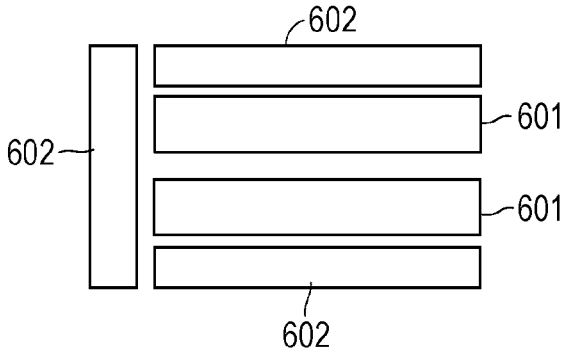

FIG. 9A

| No. | POST-PROCESSING | POST-PROCESS | OUTPUT MATTER | WHERE TO EJECT | | FUNCTIONAL UNIT | | | | NOTES |
|---|---|---|---|---|---|---|---|---|---|---|
| | | | | DOWNSTREAM POST-PROCESSING APPARATUS | PURGE | SLOT #4 | SLOT #3 | SLOT #2 | SLOT #1 | |
| 1 | (1) FOUR-SIDE CUTTING | FS MAIN TRAY<br>LS MAIN TRAY<br>SD BOOK BODY<br>PB BOOK BODY<br>OTHERS | SHEET<br>FLYER<br>ADVERTISEMENT<br>BANNER<br><FOLDED><br>BANNER<br>BOOK COVER<br>LEAFLET<br>CATALOG<br>PAMPHLET<br>PHOTO ALBUM<br>BOOKLET | ○ PAPER LENGTH OF LESS THAN OR EQUAL TO 490mm IS ACCEPTED<br>× LONG LENGTH NOT ACCEPTED | ○ ALL ACCEPTED | DUMMY/ OTHERS | DUMMY/ OTHERS | FD SLIT | CD CUTTING | · TO EJECT DOWNSTREAM PAPER HAVING PAPER LENGTH OF LESS THAN OR EQUAL TO 490mm, IT IS NECESSARY TO ARRANGE CD CUTTING IN SLOT #1 |
| 2 | (2) MULTIPLE CUTTING (e.g. TWO SHEETS OF A4) | TU PURGE<br>FS MAIN TRAY<br>LS MAIN TRAY<br>PB BOOK BODY<br>OTHERS | | ○ PAPER LENGTH OF LESS THAN OR EQUAL TO 490mm IS ACCEPTED<br>× LONG LENGTH NOT ACCEPTED | ○ ALL ACCEPTED | DUMMY/ OTHERS | DUMMY/ OTHERS | FD SLIT | CD CUTTING | · TO EJECT DOWNSTREAM PAPER HAVING PAPER LENGTH OF LESS THAN OR EQUAL TO 490mm, IT IS NECESSARY TO ARRANGE CD CUTTING IN SLOT #1 |
| 3 | (1) FOUR-SIDE CUTTING & (3) CREASE | PB COVER<br>SD COVER<br>SD FOLDING<br>LONG LENGTH CREASING (FOR FOLDING) | | ○ PAPER LENGTH OF LESS THAN OR EQUAL TO 490mm AND LENGTH FROM TOP END TO LAST CREASE POSITION OF LESS THAN OR EQUAL TO 430mm IS ACCEPTED<br>× LONG LENGTH NOT ACCEPTED | ○ ALL ACCEPTED | DUMMY/ OTHERS | FD SLIT | CREASE | CD CUTTING | · TO EJECT DOWNSTREAM PAPER HAVING PAPER LENGTH OF LESS THAN OR EQUAL TO 490mm, IT IS NECESSARY TO ARRANGE CD CUTTING IN SLOT #1 |
| 4 | (1) FOUR-SIDE CUTTING & (3) CREASE | TU PURGE | FOLDED CARDS<br>SHOPPING CARD<br>GREETING CARD<br>STAMP CARD<br>INVITATION CARD | × NOT ACCEPTED (DIVIDED INTO MULTIPLE SHEETS) | ○ ALL ACCEPTED | CD CUTTING | MARGIN CUTTING SLIT | CREASE | FD SLIT | · IT IS NECESSARY TO MANUALLY CHANGE WIDTH OF BLADE FOR MARGIN CUTTING |

FIG. 9B

| No. | POST-PROCESSING | POST-PROCESS | OUTPUT MATTER | WHERE TO EJECT | | FUNCTIONAL UNIT | | | | NOTES |
|---|---|---|---|---|---|---|---|---|---|---|
| | | | | DOWNSTREAM POST-PROCESSING APPARATUS | PURGE | SLOT #4 | SLOT #3 | SLOT #2 | SLOT #1 | |
| 5 | (2) MULTIPLE CUTTING (CARD) | TU PURGE | CARDS<br>SHOPPING CARD<br>GREETING CARD<br>STAMP CARD<br>INVITATION CARD | × NOT ACCEPTED (DIVIDED INTO MULTIPLE SHEETS) | ○ALL ACCEPTED | CD CUTTING | MARGIN CUTTING SLIT | DUMMY/ OTHERS | FD SLIT | ·IT IS NECESSARY TO MANUALLY CHANGE WIDTH OF BLADE FOR MARGIN CUTTING |
| 6 | (2) MULTIPLE CUTTING (BUSINESS CARD) | TU PURGE OR DEDICATED STACKER | BUSINESS CARD/ CARD | × NOT ACCEPTED (DIVIDED INTO MULTIPLE SHEETS) | ○ALL ACCEPTED OR DEDICATED STACKER | CD CUTTING | BUSINESS CARD SLIT | DUMMY/ OTHERS | FD SLIT | ·IT IS NECESSARY TO MANUALLY CHANGE WIDTH OF BLADE |
| 7 | (1) FOUR-SIDE CUTTING & (4) SEWING MACHINE | TU PURGE | TICKET COUPON | × NOT ACCEPTED | ○ALL ACCEPTED | CD CUTTING | FD SEWING MACHINE | CD SEWING MACHINE | FD SLIT | |
| 8 | (2) MULTIPLE CUTTING & (4) SEWING MACHINE | TU PURGE | | × NOT ACCEPTED (DIVIDED INTO MULTIPLE SHEETS) | ○ALL ACCEPTED | CD CUTTING | FD SEWING MACHINE | CD SEWING MACHINE | FD SLIT | |

POST-PROCESSING APPARATUS, IMAGE FORMING SYSTEM, AND CONTROL PROGRAM FOR POST-PROCESSING APPARATUS

The entire disclosure of Japanese patent Application No. 2017-245083, filed on Dec. 21, 2017, is incorporated herein by reference in its entirety.

BACKGROUND

Technological Field

The present invention relates to a post-processing apparatus, an image forming system, and a control program for the post-processing apparatus.

Description of the Related Art

There are known post-processing apparatuses capable of performing a plurality pieces of post-processing solo by switching a plurality of functional units that perform post-processing such as cutting papers, forming creasing and perforation.

JP 2005-239308 A discloses a paper processing apparatus that performs processing on a paper while conveying the paper, the apparatus including an optional processing device that performs processing of optionally selected contents as a functional unit, in which the optional processing device is provided freely attachably to and detachably from the main body of the apparatus. Moreover, JP 2005-239312 A discloses a paper processing apparatus having a cutting device and a creasing forming device as functional units, in which the cutting device and the creasing forming device are provided freely attachably to and detachably from the main body of the apparatus.

In the paper processing apparatus of JP 2005-239312 A, the cutting device and the creasing forming device are arranged in series along a conveyance path to allow these pieces of processing to be sequentially performed. In this manner, by increasing the number of functional units to be loaded in a post-processing apparatus and combining the units, more complex post-processing functions can be implemented.

However, as the number of functional units increases and combinations become complicated, there are cases where post-processing cannot be performed depending on the paper size even when the same post-processing is performed. A user of the post-processing apparatus deals with such a case by switching the functional units.

Particularly, since in post-processing into a direction orthogonal to a paper conveyance direction (hereinafter referred to as "cross direction (CD)"), it is necessary to temporarily stop the paper conveyance, there are constraints such as that a paper is pulled by a post-processing apparatus connected in a later stage. As a result, post-processing may not be performed accurately in some cases. In order to avoid such constraints, the user switches functional units.

However, there is a problem that it is difficult for a user to confirm, at the time of switching the functional units, whether desired post-processing can be performed by the current combination of functional units.

There is also another problem that it is difficult for the user to grasp all of the constraints or prohibition conditions since constraints or prohibition conditions of post-processing functions differ depending on a loading position even with the same functional units.

SUMMARY

The present invention has been made in view of the above circumstances, and it is an object of the present invention to provide a post-processing apparatus that presents whether post-processing desired by a user can be performed, an image forming system, and a control program of the post-processing apparatus.

To achieve the abovementioned object, according to an aspect of the present invention, a post-processing apparatus that performs, by one or more functional units which can be switched one another, predetermined post-processing corresponding to a function of the one or more functional units on a conveyed paper, reflecting one aspect of the present invention comprises: a plurality of slots in which the one or more functional units can be loaded at respective loading positions along a conveyance path; a loading detector that detects that the one or more functional units are loaded in the slots; and a condition output part that outputs a condition that allows the post-processing depending on the loading positions of the slots in which the one or more functional units are loaded.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 5A is a table illustrating an example of positions of functional units in the first post-processing apparatus and conditions under which post-processing can be performed;

FIG. 5B is a schematic diagram illustrating a representative example of post-processing that can be performed by the combination of functional units illustrated in FIG. 5A;

FIG. 6A is a table illustrating another example of positions of functional unit in the first post-processing apparatus and conditions under which post-processing can be performed;

FIG. 6B is a schematic diagram illustrating a prohibition condition with the combination of functional units illustrated in FIG. 6A;

FIG. 6C is a schematic diagram illustrating a representative example of post-processing that can be performed by the combination of functional units illustrated in FIG. 6A;

FIG. 6D is a schematic diagram illustrating a representative another example of post-processing that can be performed by the combination of functional units illustrated in FIG. 6A;

FIG. 7A is a table illustrating another example of positions of functional unit in the first post-processing apparatus and conditions under which post-processing can be performed;

FIG. 7B is a schematic diagram illustrating a prohibition condition with the combination of functional units illustrated in FIG. 7A;

FIG. 7C is a schematic diagram illustrating a representative example of post-processing that can be performed by the combination of functional units illustrated in FIG. 7A;

FIG. 7D is a schematic diagram illustrating a representative another example of post-processing that can be performed by the combination of functional units illustrated in FIG. 7A;

FIG. 9A is a table illustrating a list of representative post-processing implemented by combinations of functional units in the first post-processing apparatus and conditions under which the post-processing can be performed;

FIG. 9B is a table continued from FIG. 9A;

DETAILED DESCRIPTION OF EMBODIMENTS

Hereinafter, one or more embodiments of the present invention will be described with reference to the drawings. However, the scope of the invention is not limited to the disclosed embodiments. Note that in the description of the drawings, the same elements are denoted by the same symbol, and redundant descriptions are omitted. Dimension ratios of the drawings are exaggerated for convenience of explanation and may be different from the actual ratios.

<Image Forming System 100>

Figure 1:
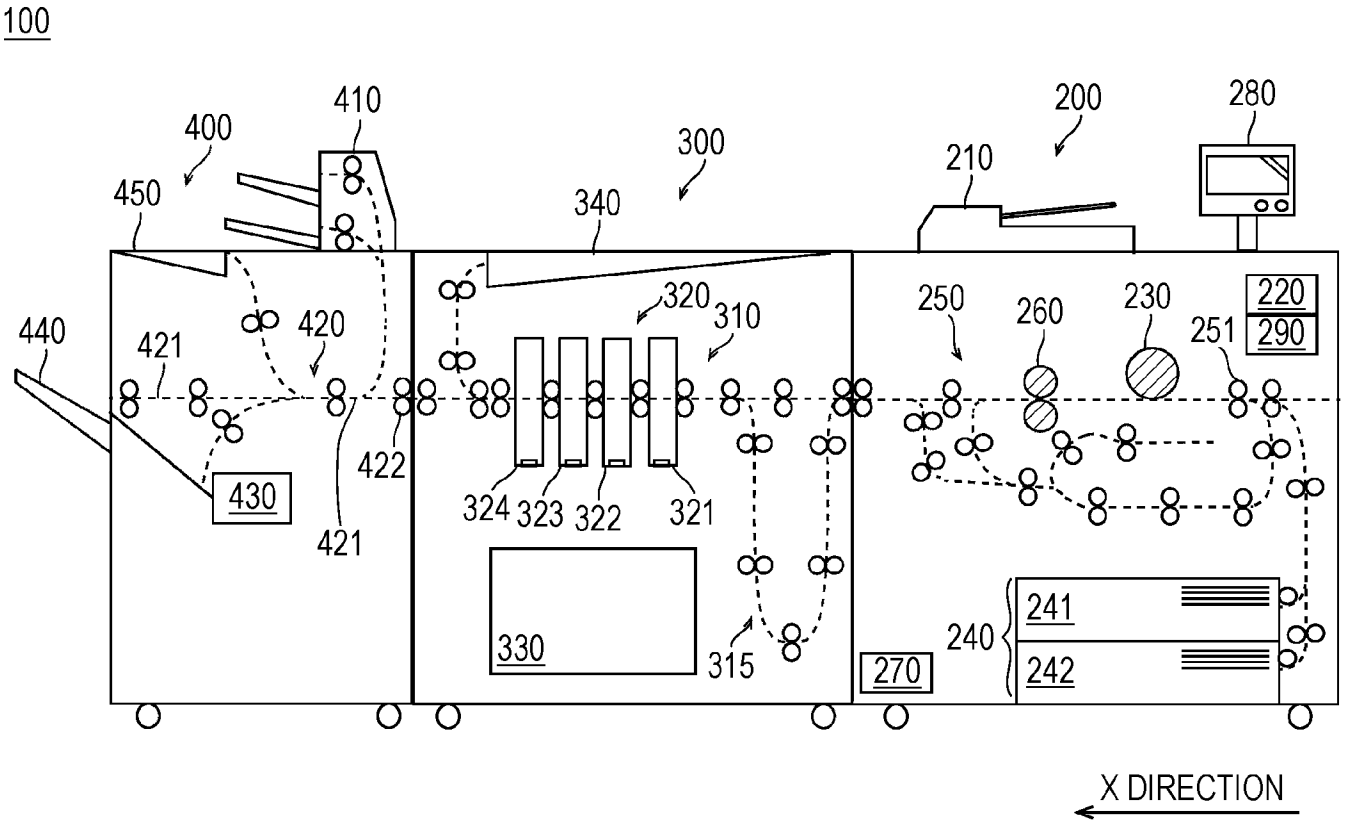
FIG. 1 is a schematic cross-sectional view of an image forming system according to an embodiment of the present invention.
Figure 2:
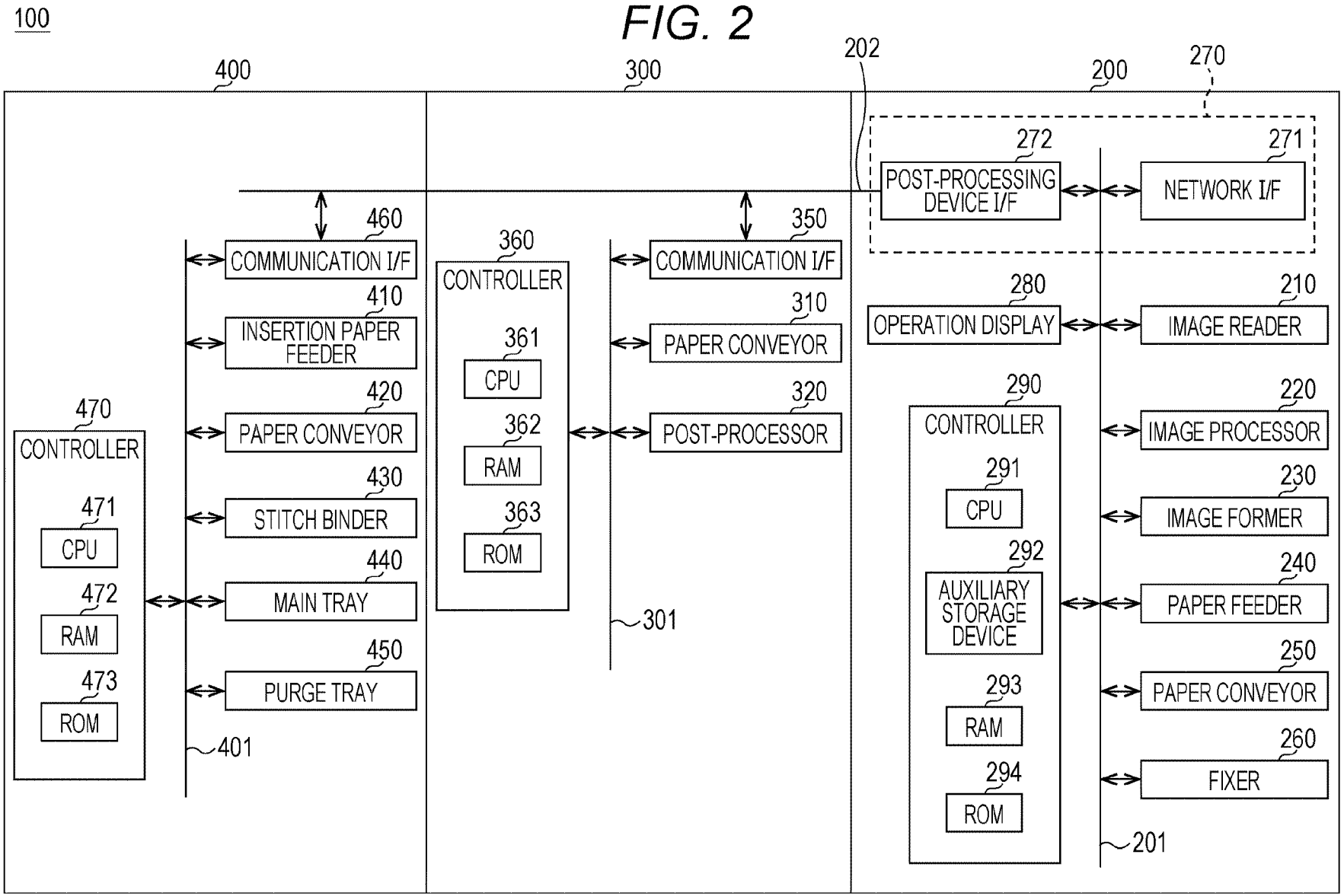
FIG. 2 is a schematic block diagram of the image forming system illustrated in FIG. 1.
Figure 3:
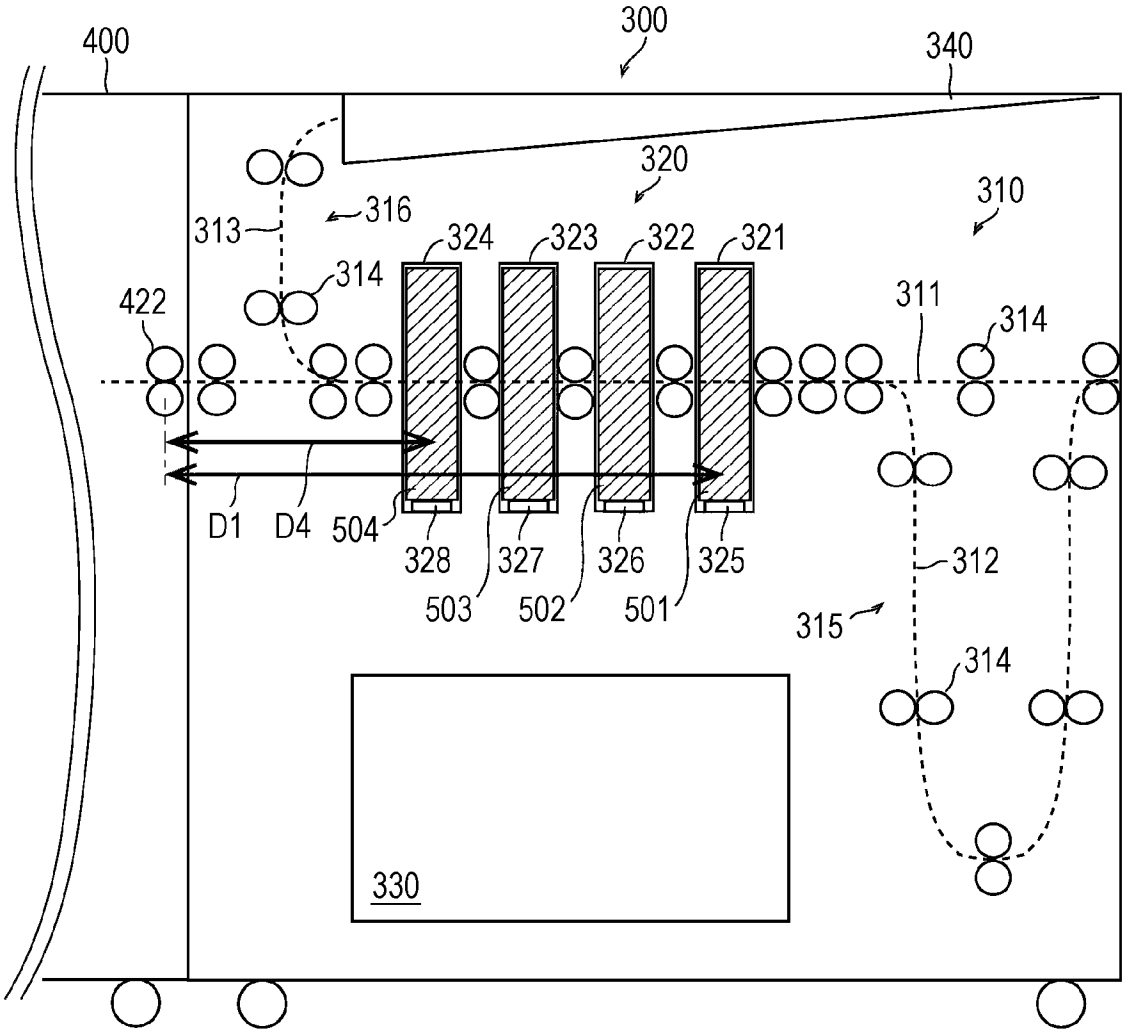
FIG. 3 is a schematic cross-sectional view illustrating an exemplary configuration of a first post-processing apparatus illustrated in FIG. 1.

FIG. 1 is a schematic cross-sectional view of an image forming system 100 according to an embodiment, and FIG. 2 is a schematic block diagram of the image forming system 100 illustrated in FIG. 1. FIG. 3 is a schematic cross-sectional view illustrating an exemplary configuration of a first post-processing apparatus illustrated in FIG. 1.

As illustrated in FIG. 1, the image forming system 100 according to the present embodiment includes an image forming apparatus 200, a first post-processing apparatus 300, and a second post-processing apparatus 400 connected in series along an X direction (paper conveyance direction). Note that the configuration of the image forming system 100 illustrated in FIG. 1 is merely an example, and the type and the number of devices included in the image forming system 100 are not limited to the example illustrated in FIG. 1. The image forming system 100 may further include a paper feeding device on the upstream side in the X direction of the image forming apparatus 200.

<Image Forming Apparatus 200>

The image forming apparatus 200 reads an image from a document and forms (prints) the read image on a paper. Alternatively, the image forming apparatus 200 receives a print job including print data in the page description language (PDL) format and print setting data from an external client terminal through a network, and forms an image on a paper on the basis of the print job. The client terminal may be, for example, a personal computer, a tablet terminal, a smartphone, or the like.

As illustrated in FIG. 2, the image forming apparatus 200 includes an image reader 210, an image processor 220, an image former 230, a paper feeder 240, a paper conveyor 250, a fixer 260, a communicator 270, an operation display 280, and a controller 290. These components are connected by an internal bus 201 so as to allow communication thereamong.

The image reader 210 includes an optical system including a mirror, a lens, and the like, and a reading sensor. The image reader 210 reads a document placed on a reading surface or a document conveyed by an auto document feeder (ADF) and outputs image signals.

The image processor 220 performs various types of image processing on an image signal received from the image reader 210 to generate print image data. The image processor 220 further generates print image data on the basis of print setting information and print data included in the print job received by the communicator 270. The generated print image data is transmitted to the image former 230.

The image former 230 forms an image on a paper on the basis of the print image data by using a known image forming process such as an electrophotographic method including charging, exposure, development, and transfer steps.

The image former 230 includes a photoreceptor drum as an image carrying member and a charger, an optical writer, a developing device, and a transferor arranged around the photoreceptor drum.

The photoreceptor drum is caused to rotate at a predetermined speed by a drum motor (not illustrated). The charger includes a corona discharger arranged around the photoreceptor drum and charges the surface of the photoreceptor drum by ions generated thereby. The optical writer incorporates a scanning optical device. The optical writer exposes the charged photoreceptor drum on the basis of input printing image data to reduce the charge in the exposed part and thereby forms a charge pattern (electrostatic latent image) corresponding to the printing image data. The developing device develops the formed electrostatic latent image, visualizes the image by toner, and forms a toner image. The transferor transfers the toner image on the photoreceptor drum onto a paper.

The paper feeder 240 supplies papers as a recording material to the image former 230. The paper feeder 240 includes an upper tray 241 and a lower tray 242. Papers of different sizes such as A4 size and A3 size can be accommodated in each of the trays.

The paper conveyor 250 conveys papers in the image forming apparatus 200. The paper conveyor 250 has a conveyance path and a plurality of pairs of conveyance rollers. The paper conveyor 250 also includes a paper reverser and a circulating conveyor and thus is capable of ejecting a paper after reversing the front and back sides of the paper after fixation or forming images on both sides of a paper.

The paper supplied from the paper feeder 240 is conveyed on the conveyance path toward the image former 230. At a pair of resist rollers 251, a timing at which the paper is conveyed to the transferor is controlled through synchronization with the toner image formed on the photoreceptor drum. The paper on which the toner image has been transferred by the transferor is conveyed to the fixer 260.

The fixer 260 fixes the toner image formed on the paper. The fixer 260 includes a hollow heating roller inside which a heater is arranged and a pressure roller facing the heating roller. The heating roller and the pressure roller are controlled at a predetermined temperature (for example, 100° C. or higher) by the heater to apply heating and pressing processing to the paper to fix the toner image.

The paper on which the image is fixed is supplied to the first post-processing apparatus 300 through a paper ejector (not illustrated).

The communicator 270 has a network I/F 271 and a post-processing apparatus I/F 272. The network I/F 271 is connected to a client terminal such as a personal computer via a network to transmit or receive data such as a print job.

The post-processing apparatus I/F 272 is communicably connected to the first post-processing apparatus 300 and the second post-processing apparatus 400 via a communication line 202 to transmit or receive data.

The operation display 280 has an input part and an output part. The input part includes, for example, a keyboard and a touch panel, and is used for a user to perform various instructions (input) such as inputting characters, various settings, and start instruction. The output part includes a display and is used for presentation, to a user, of a configuration of the apparatus, an execution status of a print job, conditions that allow post-processing, a picture of an output image, occurrence of abnormality (paper jam) in paper conveyance, etc.

The controller 290 controls the image reader 210, the image processor 220, the image former 230, the paper feeder 240, the paper conveyor 250, the fixer 260, the communicator 270, and the operation display 280. The controller 290 includes a CPU 291, an auxiliary storage device 292, a RAM 293, and a ROM 294.

The CPU 291 executes a control program for the image forming apparatus. The control program is stored in the auxiliary storage device 292 and is loaded to the RAM 293 when executed by the CPU 291. The auxiliary storage device 292 includes a large-capacity storage device such as a hard disk drive and a flash memory. In the RAM 293, calculation results accompanying execution of the CPU 291, the position and type of functional units loaded in the first post-processing apparatus 300, prohibition condition information which will be described later, etc. are stored. In the ROM 294, various parameters, various programs, and the like are stored. The CPU 291 executes the control program to implement various functions.

<First Post-Processing Apparatus 300>

The first post-processing apparatus 300 conveys or post-processes the paper supplied from the image forming apparatus 200 in accordance with an instruction from the image forming apparatus 200 and supplies the paper to the second post-processing apparatus 400 or ejects to a purge tray 340.

The first post-processing apparatus 300 is arranged between the image forming apparatus 200 and the second post-processing apparatus 400 in the image forming system 100 and includes a paper conveyor 310, a post-processor 320, a trash box 330, the purge tray 340, a communication I/F 350, and a controller 360. These components are connected by an internal bus 301 so as to allow communication thereamong.

As illustrated in FIG. 3, the paper conveyor 310 includes conveyance paths 311, 312, and 313 and a plurality of pairs of conveyance rollers 314 and conveys the paper supplied from the image forming apparatus 200 along the conveyance paths 311, 312, or 313.

The paper conveyor 310 further has a long paper conveyor 315 and a purge conveyor 316. The long paper conveyor 315 conveys a long paper supplied from the image forming apparatus 200 while aligning the paper. More specifically, the long paper conveyor 315 temporarily holds the long paper supplied from the image forming apparatus 200 in the conveyance path 312 and aligns the paper in terms of inclination with respect to the conveyance direction (adjust to correct orientation) before conveyance to the post-processor 320. The purge conveyor 316 conveys the paper from the post-processor 320 to the purge tray 340. Note that although illustration is simplified, the purge conveyor 316 may include a number of pairs of conveyance rollers 314 along the conveyance path 313 such that papers cut into a card size or a business card size in the post-processor 320 can be reliably conveyed.

The post-processor 320 performs post-processing on a paper by one or more functional units. The post-processor 320 has a plurality of slots 321 to 324 for loading functional units. The slots 321 to 324 each have a slot number (#1 to #4). Functional units are loaded at respective loading positions along the conveyance path. A loading position is defined by the position on the conveyance path (position in the X direction). In FIG. 1, a case where no functional unit is loaded in any of the slots 321 to 324 is illustrated. On the other hand, in FIG. 3, a case where functional units 501 to 504 are loaded in the slots 321 to 324, respectively, is illustrated. Each of the functional units 501 to 504 can be loaded in any of the slots 321 to 324 although there are prohibition conditions as will be described later and can be switched one another. Moreover, it is not necessary to load the functional units 501 to 504 in all of the slots 321 to 324.

Only some of the slots 321 to 324 may be loaded. When the slots 321 to 324 are empty, dummy units are loaded in such a manner that no disturbance is caused in paper conveyance.

Furthermore, detection sensors 325 to 328 are installed in the slots 321 to 324, respectively. In cooperation with the controller 360, the detection sensors 325 to 328 determine whether each of the functional units 501 to 504 is installed and in the case where a functional unit is loaded in any of the slots 321 to 324, the type of the functional unit and whether loaded, that is, information of the loading position are acquired. The detection sensors 325 to 328 and the controller 360 function as loading detectors and type detectors.

The detection sensors 325 to 328 may be of any form as long as the detection sensor can detect whether a functional unit is loaded and the type of the functional unit. For example, a light sensor, an actuator, or the like may be used. Alternatively, a connector in the main body of the first post-processing apparatus 300 and a connector of a functional unit may be fitted and electrically connected to allow the controller 290 to detect whether loaded and to read an identification number stored in a control board of the functional unit after the connection, thereby allowing the type of the functional unit to be detected (determined).

The functional units 501 to 504 may be any one of, for example, a CD cutting unit, a top/bottom slit (FD cutting) unit, a margin cutting slit unit, a crease unit, a CD sewing machine unit, an FD sewing machine unit, and a business card slit unit.

The CD cutting unit is a unit that cuts a paper in the CD direction. The top/bottom slit is a unit that cuts a paper in the paper conveyance direction and is also called a feed direction (FD) cutting unit. Hereinafter, the paper conveyance direction is also referred to as the "FD direction".

The margin cutting slit unit is a unit that forms a slit in the FD direction. For example, in the margin cutting slit processing, cutting is performed with two parallel cutting lines with a slit (groove) formed between the two cutting lines. The crease unit is a unit that forms a streak in a predetermined direction, for example, the CD direction.

The CD sewing machine unit is a unit that forms a perforation in the CD direction, and the FD sewing machine unit is a unit that forms a perforation in the FD direction. The business card slit unit is a unit that forms a plurality of slits in the FD direction in order to cut a paper into the size of a business card.

Note that the post-processor 320 may also use a functional unit other than the above. The cutting waste cut by functional units involved in cutting of papers falls to the trash box 330 by its own weight and accumulates. A user periodically discards the cutting waste in the trash box.

The communication I/F 350 is communicably connected to the post-processing apparatus I/F 272 of the image forming apparatus 200 via the communication line 202 to transmit or receive data.

The controller 360 controls the paper conveyor 310, the post-processor 320, and the communication I/F 350. The controller 360 includes a CPU 361, a RAM 362, and a ROM 363.

The CPU 361 executes a control program for the first post-processing apparatus and implements various functions. The RAM 362 stores calculation results or processing results of the CPU 361, the position and type of functional units loaded in the post-processor 320, prohibition condition information which will be described later, etc. The ROM 363 stores the control program, various parameters including loading positions (positions in the conveyance path) corresponding the slots (or slot numbers), and other data.

The controller 360 acquires the type of functional units and the loading position on the basis of detection results of the detection sensors 325 to 328. For example, a unit number unique to each type of all functional units that can be loaded in the slots 321 to 324 may be allocated in advance. The unit number can be acquired as information of the type of the loaded functional unit. The correspondence between unit numbers and the type of functional units can be stored in the RAM 362 as a table.

When the correspondence is denoted as "name of functional unit (unit number)," unit numbers are allocated in a manner such as CD cutting (1), FD slit (2), margin cutting slit (3), crease (4), CD sewing machine (5), FD sewing machine (6), business card slit (7), and dummy (8).

Alternatively, an identification number unique to every functional unit that can be loaded in the slots 321 to 324 may be allocated in advance, and the identification number can be acquired as information of the type of the loaded functional unit. The correspondence between identification numbers and the type of functional units can be stored in the RAM 362 as a table.

Furthermore, as information of loading positions, for example slots #1 to #4 may be used. The slots #1 to #4 correspond to the slots 321 to 324, respectively. The slots 321 to 324 are arranged in the order of the slots 321, 322, 323, and 324 from the side close to the image forming apparatus 200, and distances from a predetermined reference position in the conveyance path to each of the slots 321 to 324 are defined in advance, which are stored in the ROM 363. Therefore, by specifying one of the slots #1 to #4, a loading position is uniquely determined.

The controller 360 functions as a condition output part and derives conditions that allow post-processing by the post-processor 320 depending on loading positions of functional units detected by the detection sensors 325 to 328. Details of conditions that allow post-processing will be described later.

<Second Post-Processing Apparatus 400>

The second post-processing apparatus 400 conveys or post-processes a paper supplied from the first post-processing apparatus 300 in accordance with an instruction from the image forming apparatus 200 and ejects the paper to the outside of the image forming system 100. The second post-processing apparatus 400 is arranged most downstream in the image forming system 100 and includes an insertion paper feeder 410, a paper conveyor 420, a stitch binder 430, a main tray 440, a purge tray 450, a communication I/F 460, and a controller 470. These components are connected by an internal bus 401 so as to allow communication thereamong.

The insertion paper feeder 410 includes one or more paper feed trays. In the paper feed trays of the insertion paper feeder 410, for example, pre-printed papers, colored papers, etc. are loaded and used as, for example, a front cover of a printed bundle or an insertion paper for dividing chapters. Papers placed in the paper feed trays are fed at a predetermined timing on the basis of the print setting information.

The paper conveyor 420 includes a conveyance path 421 and a plurality of pairs of conveyance rollers 422 and conveys the paper supplied from the first post-processing apparatus 300 along the conveyance path 421. The paper conveyor 420 also conveys a paper supplied from the first post-processing apparatus 300 or the insertion paper feeder 410 along the conveyance path 421. The paper conveyor 420 also conveys a booklet side-stitched by the stitch binder 430 to the main tray 440.

The stitch binder 430 includes a stacker that accumulates papers and a stapler that staples a bundle of papers. The stitch binder 430 staples an end of a bundle of papers to side-stitch the bundle of papers to produce a booklet.

The main tray 440 ejects valid papers out of the papers conveyed by the paper conveyor 420. The purge tray 450 ejects invalid paper out of the papers conveyed by the paper conveyor 420.

The communication I/F 460 is communicably connected to the post-processing apparatus I/F 272 of the image forming apparatus 200 via the communication line 202 to transmit or receive data.

The controller 470 controls the insertion paper feeder 410, the paper conveyor 420, the stitch binder 430, the main tray 440, the purge tray 450, and the communication I/F 460. The controller 470 includes a CPU 471, a RAM 472, and a ROM 473.

The CPU 471 executes a control program for the second post-processing apparatus and implements various functions. The RAM 472 stores calculation results, processing results, and other data of the CPU 471. The ROM 473 stores the control program, various parameters, and other data.

<Control Method of Image Forming System 100>

Figure 4A:
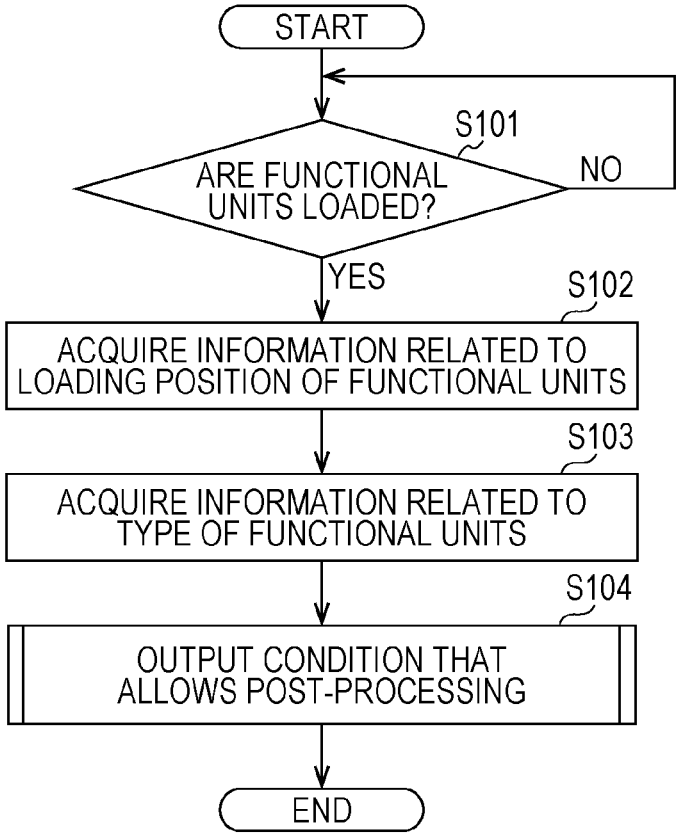
FIG. 4A is a flowchart illustrating an exemplary processing procedure of a control method of an image forming system according to an embodiment of the present invention.
Figure 4B:
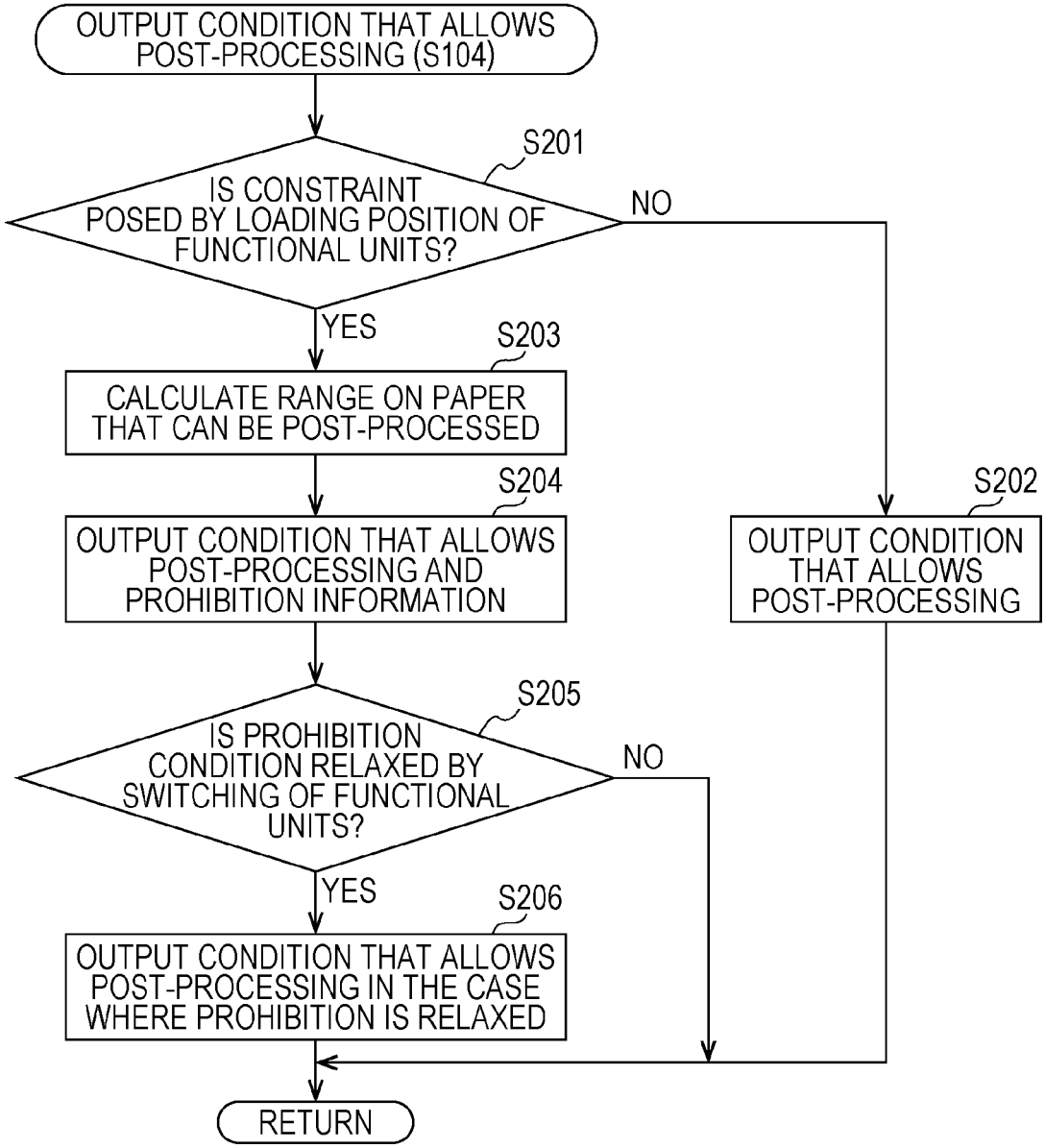
FIG. 4B is a flowchart of a subroutine illustrating exemplary processing of step S104 illustrated in FIG. 4A.

With reference to FIGS. 4A and 4B, a control method of the image forming system 100 according to the present embodiment will be described. FIG. 4A is a flowchart illustrating an exemplary processing procedure of a control method of the image forming system 100 according to the present embodiment. FIG. 4B is a subroutine flowchart illustrating exemplary processing of step S104 in FIG. 4A. Note that processing illustrated FIGS. 4A and 4B is implemented by cooperation of the controller 290 and the controller 360.

As illustrated in FIG. 4A, it is determined whether a functional unit is loaded (step S101). The controller 360 determines whether a functional unit is loaded in each of the slots 321 to 324 on the basis of detection results of the detection sensors 325 to 328, respectively.

If it is determined that no functional unit is loaded in any of the slots 321 to 324 (step S101: NO), the flow stands by until it is determined that a functional unit is loaded in any one of the slots 321 to 324 (step S101: NO).

On the other hand, when it is determined that a functional unit is loaded in any one of the slots 321 to 324 (step S101: YES), information of the loading position of the functional unit is acquired (step S102). In the example illustrated in FIG. 3, the functional units 501 to 504 are loaded in the slots 321 to 324, respectively. The controller 360 acquires, as information of loading positions of the functional units in the post-processor 320, the slots #1 to #4 on the basis of the detection results of the detection sensors 325 to 328.

Subsequently, information of the type of the functional units is acquired (step S103). The controller 360 acquires information of the type of the functional units 501 to 504 on the basis of the detection results of the detection sensors 325 to 328. For example, the controller 360 acquires unit numbers 1, 2, 8, and 8 as the information of the type of the functional units 501 to 504, respectively. That is, the functional units 501 to 504 correspond to CD cutting (1), FD slit (2), dummy (8), and dummy (8), respectively.

Subsequently, conditions that allow post-processing are output (step S104). The controller 360 outputs conditions that allow post-processing by the post-processor 320 depending on the type and the loading position of the functional units 501 to 504. More specifically, it is as follows.

<Output of Conditions that Allow Post-Processing (Step S104)>

As illustrated in FIG. 4B, it is determined whether constraints are posed by loading positions of functional units (step S201). Since post-processing in the CD direction requires paper conveyance to be temporarily stopped, depending on a position on a paper at which the post-processing is to be performed, there is a possibility that a constraint is posed such as that the paper is pulled by the second post-processing apparatus 400 connected in a later stage while the post-processing is performed. Note that, in consideration of complexity of control and compatibility, in the control of the second post-processing apparatus 400, changes of control such as that of paper conveyance timing depending on a change in the configuration of functional units in the first post-processing apparatus 300 are not performed in the present embodiment.

As illustrated in FIG. 3, a distance between a loading position of the slot 321 and the pair of conveyance rollers 422 of the second post-processing apparatus 400 is defined as D1, and a distance between a loading position of the slot 324 and the pair of conveyance rollers 422 as D4. Although not illustrated, a distance between a loading position of the slot 322 and the pair of conveyance rollers 422 and a distance between a loading position of the slot 323 and the pair of conveyance rollers 422 are similarly defined as D2 and D3, respectively.

In the case where the functional unit 501 of the slot 321 performs post-processing, if the position where the post-processing is performed is within the distance D1 from the top of the paper, the paper is not pulled by the second post-processing apparatus 400 while the functional unit 501 is performing the post-processing. Moreover, in the case where the functional unit 504 of the slot 324 performs post-processing, if the position where the post-processing is performed is within the distance D4 from the top of the paper, the paper is not pulled by the second post-processing apparatus 400 while the functional unit 504 is performing the post-processing.

In the following description, the case where the distances D1 to D4 are set to 500, 370, 240, and 110 mm, respectively, will be illustrated for the sake of convenience. Furthermore, the example where the functional unit of the slot 321 is capable of post-processing a paper having a length of up to 490 mm is illustrated. However, the values of the distances D1 to D4 and paper sizes that can be post-processed are not limited to above cases.

The controller 360 determines whether a constraint is posed by the loading positions of the functional units. More specifically, the controller 360 determines whether constraints are posed on the basis of the types and loading positions of the functional units 501 to 504 loaded in the slots 321 to 324.

FIG. 5A is a table illustrating an example of positions of functional units and conditions that allow post-processing to be performed at these positions. FIG. 5B is a schematic diagram illustrating a representative example of post-processing that can be performed by the combination of functional units in FIG. 5A.

In the example illustrated in FIG. 5A, a CD cutting unit, an FD slit unit, a dummy unit, and another dummy unit are loaded in the slots #1 to #4, respectively, as functional units. Out of the above, a functional unit that performs post-processing in the CD direction is only the CD cutting unit. The CD cutting unit is loaded in the slot #1. CD cutting processing can be performed at any position in the FD direction as long as a paper length is less than or equal to 490 mm. While the CD cutting unit is performing the cutting processing, the second post-processing apparatus 400 does not pull the paper. Therefore, with the above arrangement of functional units, no constraint is posed on the post-processing.

If no constraint is posed by loading positions of functional units (step S201: NO), the controller 360 outputs conditions that allow post-processing (step S202). As illustrated in FIG. 5A, on the basis of types and positions of functional units of the CD cutting unit, the FD slit unit, the dummy unit, and the other dummy unit the loaded in the slots #1 to #4 the, the controller 360 displays conditions that allow post-processing on a display of the operation display 280 or print the conditions on a paper. Specifically, as described in the column of "Where to Eject" and "Notes," the paper length can be up to 490 mm and in order to eject downstream a paper having a paper length of up to 490 mm, it is necessary to arrange the CD cutting in slot #1. Hereinafter, in the present embodiment, the act of displaying on the display of the operation display 280 or printing on a paper is referred to as to "output."

Moreover, the controller 360 outputs, as a picture of an output image, a representative example of post-processing that can be performed with the above arrangement of the functional units as illustrated in FIG. 5B. In the above arrangement of the functional units, when only the CD cutting unit is operated while the FD slit unit is not operated, cutting processing in the CD direction can be performed. Meanwhile, when the FD slit unit is operated while the CD cutting unit is not operated, cutting processing in the FD direction can be performed. When both the CD cutting unit and the FD slit unit are operated, four-side cutting processing can be performed.

FIG. 5B schematically illustrates a picture of an output image when four-side cutting processing is performed. Symbol 601 denotes a paper after the cutting processing from which four edges are removed by the four-side cutting processing, and symbol 602 denotes the removed four edges (so-called "trash portion"). What is output and actually presented to a user out of the above is only the paper 601 after the cutting processing, and the removed four edges 602 are not presented to the user.

The paper 601 after the cutting processing is either conveyed to the second post-processing apparatus 400 or conveyed to the purge tray 340 and ejected. Then, the controller 360 terminates the processing of outputting conditions that allow post-processing (return).

Next, cases where a constraint is posed by loading positions of functional units which will be explained. FIG. 6A is a table illustrating another example of positions of functional units in the first post-processing apparatus and conditions under which post-processing can be performed at these positions. FIG. 6B is a schematic diagram illustrating a prohibition condition with the combination of functional units illustrated in FIG. 6A. FIG. 6C is a schematic diagram illustrating a representative example of post-processing that can be performed by the combination of functional units illustrated in FIG. 6A. FIG. 6D is a schematic diagram illustrating another representative example of post-processing that can be performed by the combination of functional units illustrated in FIG. 6A.

Referring back to FIG. 4B, if a constraint is posed by loading positions of functional units (step S201: YES), a range on the paper that can be post-processed is calculated (step S203). The controller 360 calculates the range on the paper that can be post-processed on the basis of the types and loading positions of the functional units 501 to 504 loaded in the slots 321 to 324.

For example, a case is assumed where the CD cutting unit, the crease unit, the FD slit unit, and the dummy unit are loaded in the slots 321 to 324, respectively, as functional units.

Since the crease unit performs processing for forming a streak in the CD direction on the paper, there is a possibility that a constraint is posed depending on a position at which the processing is performed. In the above arrangement of the functional units, since the crease unit is loaded in the slot 322, the crease processing can be performed within a range of positions up to 360 mm from the top of the paper in the present embodiment, for example. That is, when the crease unit is loaded in the slot 322, this results in a constraint that a range that can be post-processed is limited to positions up to 360 mm from the top of the paper.

Next, conditions that allow post-processing and prohibition information are output (step S204). As illustrated in FIG. 6A, the controller 360 outputs conditions that allow post-processing on the basis of loading positions of the respective functional units of CD cutting, crease, an FD slit, and dummy that are loaded in the slots #1 to #4, respectively.

The controller 360 further sets 360 mm as a prohibition condition due to constraints on the crease unit. Then, as illustrated in FIG. 6B, the controller 360 outputs prohibition information 700 as a picture of an image on the basis of the prohibition condition. In FIG. 6B, an example is illustrated where a position of 360 mm from the top of the paper is the maximum as a position for forming a creased streak 701 by the crease unit.

Moreover, the controller 360 outputs, as a picture of an output image, a representative example of post-processing that can be performed with the above arrangement of the functional units as illustrated in FIGS. 6C and 6D.

FIG. 6C exemplifies the case where the CD cutting unit and the FD slit unit are operated while the crease unit is halted and four-side cutting processing is thereby performed. Furthermore, FIG. 6D exemplifies the case where the CD cutting unit, the FD slit unit, and the crease unit are all operated and four-side cutting processing and crease processing are thereby performed. Symbol 601 denotes a paper after the cutting processing from which four edges are removed by the four-side cutting processing, and symbol 602 denotes the removed four edges. Symbol 603 denotes a streak formed by the crease processing.

<Another Example where Constraint is Posed Due to Loading Positions of Functional Units>

FIG. 7A is a table illustrating another example of positions of functional units and conditions under which post-processing can be performed at these positions. FIG. 7B is a schematic diagram illustrating a prohibition condition with the combination of functional units illustrated in FIG. 7A. FIG. 7C is a schematic diagram illustrating a representative example of post-processing that can be performed by the combination of functional units illustrated in FIG. 7A. FIG. 7D is a schematic diagram illustrating another representative example of post-processing that can be performed by the combination of functional units illustrated in FIG. 7A.

For example, a case is assumed where the FD slit unit, the dummy unit, the margin cutting slit unit, and the CD cutting unit are loaded in the slots 321 to 324, respectively, as functional units.

Out of the above, a functional unit that performs post-processing in the CD direction is only the CD cutting unit. The CD cutting unit is loaded in the slot 324 and can perform CD cutting at any position in the FD direction as long as the position is within a range of 100 mm from the top of the paper. However, in a case where the position exceeds 100 mm from the top of the paper, there is a possibility that the paper is pulled by the second post-processing apparatus 400 while the CD cutting unit is performing cutting processing. Therefore, in the case where the CD cutting unit is loaded in the slot 324, a constraint is posed that the range in which post-processing can be performed is limited to positions up to 100 mm from the top of the paper.

As illustrated in FIG. 7A, the controller 360 outputs conditions that allow post-processing on the basis of the loading positions of the respective functional units of FD slit, dummy, margin cutting slit, and CD cutting that are loaded in the slots #1 to #4, respectively.

The controller 360 further sets 100 mm as a prohibition condition due to constraints on the CD cutting unit. Then, as illustrated in FIG. 7B, the controller 360 outputs prohibition information 700 as a picture of an image on the basis of the prohibition condition. In FIG. 7B, it is exemplified that a position of 100 mm from the top of the paper is the maximum as a cutting position 702 by the CD cutting unit.

Moreover, the controller 360 outputs, as a picture of an output image, a representative example of post-processing that can be performed with the above arrangement of the functional units as illustrated in FIGS. 7C and 7D.

FIG. 7C exemplifies the case where the CD cutting unit and the FD slit unit are operated while the margin cutting slit unit is halted and three-side cutting processing is thereby performed. Note that since the CD cutting unit has a constraint that the range in which cutting processing can be performed is limited to positions up to 100 mm from the top of the paper, the bottom of the paper exceeding 100 mm is not cut off. Furthermore, FIG. 7D exemplifies the case where the CD cutting unit, the FD slit unit, and the margin cutting slit unit are all operated and three-side cutting processing and margin cutting processing are thereby performed.

<Relaxation of Prohibition Conditions by Switching of Functional Units>

Figure 8A:
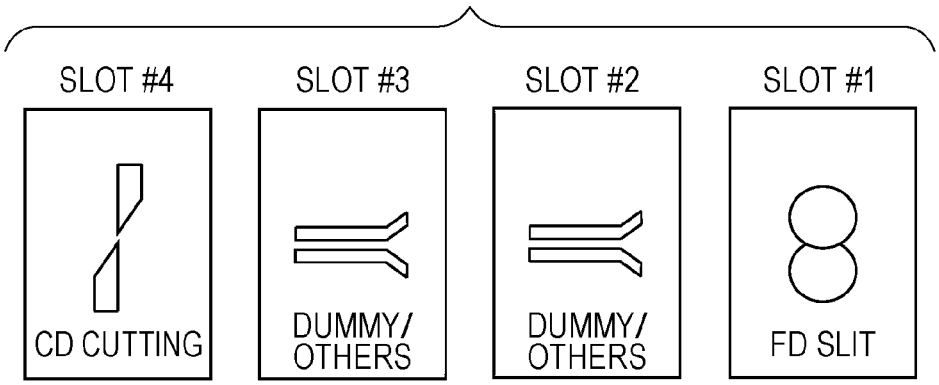
FIG. 8A is a schematic diagram illustrating an exemplary initial state of arrangement of functional units in the first post-processing apparatus.
Figure 8B:
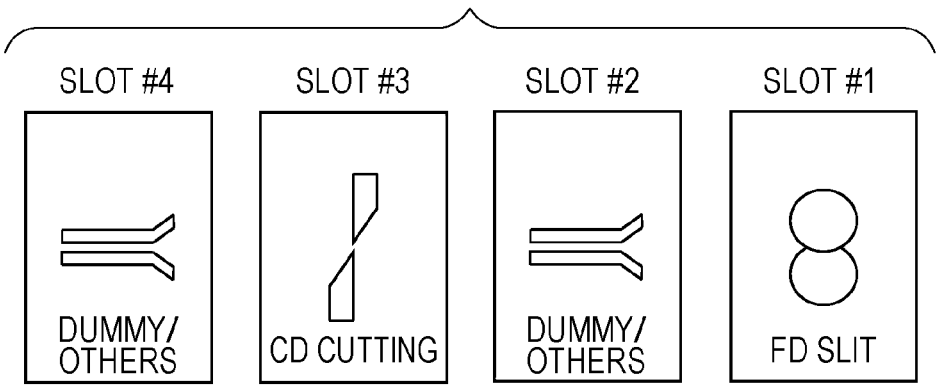
FIG. 8B is a schematic diagram illustrating an exemplary case in which an arrangement order is switched such that prohibition conditions are relaxed from the initial state of FIG. 8A.
Figure 8C:
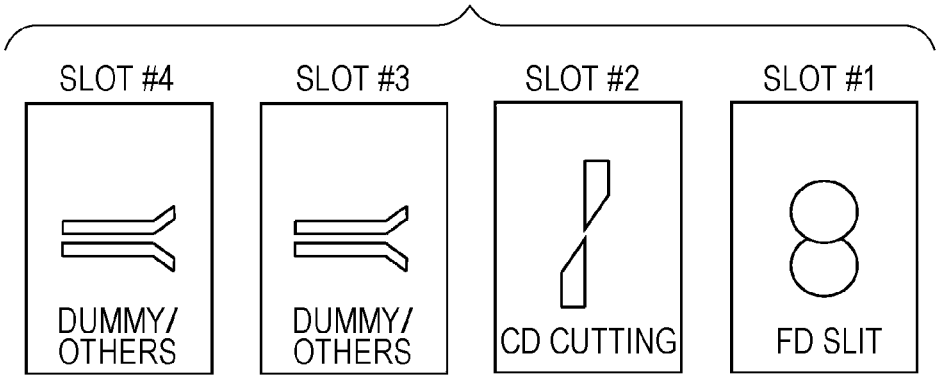
FIG. 8C is a schematic diagram illustrating an exemplary case in which an arrangement order is switched such that the prohibition conditions are relaxed from the initial state of FIG. 8A.
Figure 8D:
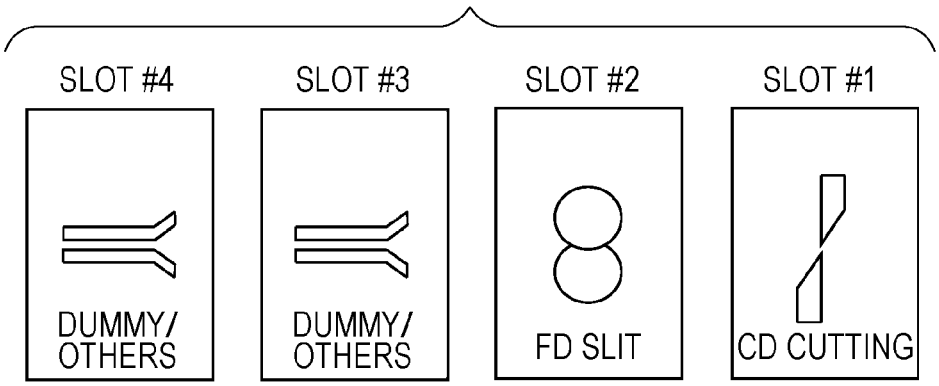
FIG. 8D is a schematic diagram illustrating an exemplary case in which an arrangement order is switched such that the prohibition conditions are relaxed from the initial state of FIG. 8A.

FIG. 8A is a schematic diagram illustrating an initial state of arrangement of functional units. FIGS. 8B to 8D are schematic diagrams illustrating an exemplary case in which an arrangement order is switched such that the prohibition conditions are relaxed from the initial state of FIG. 8A.

Again referring back to FIG. 4B, it is determined whether the prohibition condition is relaxed by switching of the functional units (step 205). For example, as illustrated in FIG. 8A, a case is assumed where the FD slit unit, the dummy unit, the other dummy unit, and the CD cutting unit are loaded in the slots #1 to #4, respectively. In this case, the range in which the CD cutting processing can be performed is 100 mm from the top of the paper. That is, the prohibition condition is 100 mm.

If the constraint is not relaxed by switching of the functional units (step S205: NO), the controller 360 terminates the processing (return).

On the other hand, if the prohibition condition is relaxed by switching of the functional units (step S205: YES), the controller 360 outputs conditions that allow post-processing in the case where the prohibition condition is relaxed (step S206). More specifically, if switching of the positions of the FD slit unit, the dummy unit, the other dummy unit, and the CD cutting unit loaded in the slots #1 to #4 relaxes the prohibition condition, the controller 360 recommends a user the order of arrangement in which the prohibition condition is relaxed. For example, the controller 360 presents orders of arrangement of the functional units as illustrated in FIGS. 8B to 8D to the user and terminates the processing (return).

As illustrated in FIG. 8B, the controller 360 may recommend the user to switch the functional units such that the CD cutting unit is positioned in the slot #3. In order to rearrange the functional units from the order of arrangement in FIG. 8A to the order of arrangement in FIG. 8B, for example, the user can accomplish this by switching the dummy unit of the slot #3 and the CD cutting unit of the slot #4. In the switched order of arrangement, the range in which the CD cutting processing can be performed is 230 mm from the top of the paper, for example. That is, the prohibition condition is changed to 230 mm, and the prohibition condition is relaxed as compared with the case illustrated in FIG. 8A.

Moreover, as illustrated in FIG. 8C, the controller 360 may recommend the user to switch the functional units such that the CD cutting unit is positioned in the slot #2. In order to rearrange the functional units from the order of arrangement in FIG. 8A to the order of arrangement in FIG. 8C, for example, the user can accomplish this by switching the dummy unit of the slot #2 and the CD cutting unit of the slot #4. In this case, the range in which the CD cutting processing can be performed is 360 mm from the top of the paper, for example. That is, the prohibition condition is changed to 360 mm, and the prohibition condition is relaxed as compared with the case illustrated in FIG. 8A.

Moreover, as illustrated in FIG. 8D, the controller 360 may recommend the user to switch the functional units such that the CD cutting unit is positioned in the slot #1. In order to rearrange the functional units from the order of arrangement in FIG. 8A to the order of arrangement in FIG. 8D, for example, the user can accomplish this by switching the dummy unit of the slot #2 and the CD cutting unit of the slot #4 and further switching the CD cutting unit of the slot #2 and the FD slit unit of the slot #1. In this case, the range in which the CD cutting processing can be performed is 490 mm from the top of the paper, for example. That is, since there is no prohibition condition, the prohibition condition is relaxed as compared with the case illustrated in FIG. 8A.

As described above, in the present embodiment, the controller 360 can present a better condition to the user with a less restrictive prohibition condition even with a combination of the same functional units (for example, the FD slit unit, the dummy unit, the other dummy unit, the CD cutting unit).

<List of Combinations of Functional Units>

Combinations of functional units will be described with reference to FIGS. 9A and 9B. FIG. 9A is a table illustrating a list of representative post-processing implemented by combinations of functional units and conditions under which the post-processing can be performed, and FIG. 9B is a table continued from FIG. 9A. The controller 360 is capable of outputting the tables illustrated in FIG. 9A and FIG. 9B in response to an instruction from the user.

In FIG. 9A, the combination of functional units indicated in "No. 1" is the same as the combination of the functional units illustrated in FIG. 5A. As described above, a typical example of post-processing may be four-side cutting processing. Note that, in the column of "post-processing" in the table, a one-dot chain line indicates to cut thereat by FD slit processing or CD cutting processing.

Post-processes may include an FS main tray (eject to the main tray after processing by the post-processing apparatus), an LS main tray (eject to the main tray after processing by a large stacker), an SD book body (saddle stitch binding), and a PB book body (case binding). Output matters may include a sheet, a flyer, an advertisement, and a banner.

As indicated in "No. 2," it is possible to perform processing for cutting a paper in the CD direction a plurality of times by the CD cutting unit with the same combination of functional units as the above "No. 1." In the table an example is illustrated where an A3-sized paper is divided into two sheets of A4 paper.

Post-processes may include trimer unit (TU) purge (eject to the purge tray 340), the FS main tray, the LS main tray, and the PB book body. Like in "No. 1," output matters may include a sheet, a flyer, an advertisement, and a banner.

The combination of functional units indicated in "No. 3" is the same as the combination of the functional units illustrated in FIG. 6A. As described above, typical examples of post-processing may be four-side cutting processing and crease processing. Note that, in the column of "post-processing" in the table, a one-dot chain line indicates to cut thereat by FD slit processing or CD cutting processing, and a bold line indicates a streak by crease processing.

Post-processes may include a PB cover (produce a cover by case binding), an SD cover (produce a cover by saddle stitch binding), SD folding (folding by saddle stitch binding), and long length creasing (for folding). Output matters may include a banner, a book cover, a leaflet, a catalog, a pamphlet, a photo album, and a booklet.

As illustrated in "No. 4," in the case where functional units of FD slit, crease, margin cutting slit, and CD cutting are loaded in the slots #1 to #4, typical examples of post-processing may be four-side cutting processing and crease processing.

A post-process may be TU purge (eject to the purge tray 340). Output matters may include folded cards (shopping card, greeting card, stamp card, invitation card, etc.).

Note that although the ejection destination may be the purge tray 340, conveyance to the downstream second post-processing apparatus 400 is not possible since the paper is divided into a plurality of sheets in the FD direction by the margin cutting slit processing.

Subsequently, in FIG. 9B, the combination of functional units indicated in "No. 5" is the same as the combination of the functional units illustrated in FIG. 7A. As described above, a typical example of post-processing may be multiple cutting processing (cards). A post-process may be the TU purge, and output matters may include cards (shopping card, greeting card, stamp card, invitation card, etc.).

The combination of functional units indicated in "No. 6" is obtained by replacing the margin cutting slit unit in "No. 5" with a business card slit unit. Post-processes may include the TU purge or a dedicated stacker, and output matters may include business cards and cards.

In "No. 7" and "No. 8," functional units of FD slit, CD sewing machine, FD sewing machine, and CD cutting are loaded in the slots #1 to #4, respectively. In the case of "No. 7," typical examples of post-processing may be four-side cutting processing and sewing processing. Furthermore, in the case of "No. 8," typical examples of post-processing may be multiple cutting processing and sewing processing. Note that, in "No. 7" and "No. 8," a broken line indicates sewing processing by the CD sewing machine or the FD sewing machine. A post-process may be the TU purge, and output matters may include tickets, coupons, etc.

Note that samples such as photographs of output matters may be displayed in the lists of FIG. 9A and FIG. 9B to facilitate a user to have a picture of the output matters.

<Exemplary Output of Post-Processed Paper>

Next, exemplary output of a paper post-processed by the first post-processing apparatus 300 will be described. FIGS. 10A to 10E are schematic diagrams illustrating exemplary output of a paper post-processed by the first post-processing apparatus 300. In FIGS. 10A to 10E, a "display (print) pattern" schematically illustrates a picture of a post-processed image displayed on the display of the operation display 280 or a picture of a post-processed image printed on a paper. "Output paper" schematically illustrates a form of paper that is output when post-processing is performed.

Figure 10A:
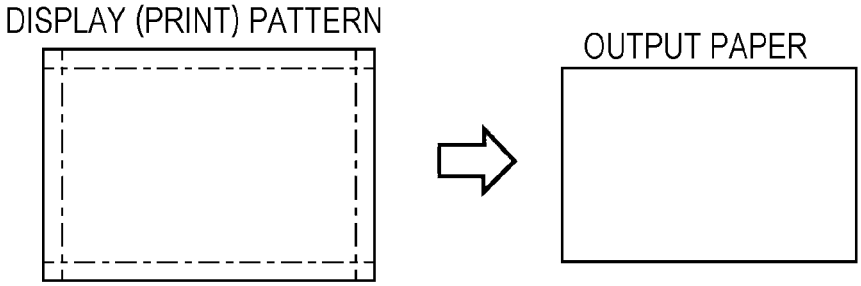
FIG. 10A is a schematic diagram illustrating an exemplary output of a paper post-processed by the first post-processing apparatus.

FIG. 10A is a diagram illustrating a case where four-side cutting processing is performed. In a "display (print) pattern," positions cut by the FD slit unit or the CD cutting unit are indicated by one-dot chain lines, for example. When the four-side cutting processing is performed, as illustrated in "output paper," a paper with four edges cut off is output.

Figure 10B:
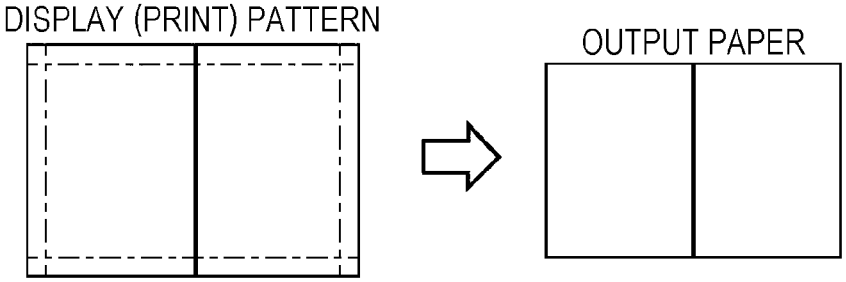
FIG. 10B is a schematic diagram illustrating an exemplary output of a paper post-processed by the first post-processing apparatus.

FIG. 10B is a diagram illustrating a case where crease processing by the crease unit is performed in addition to the four-side cutting. In this case, a paper the four edges of which are cut off and a streak is formed thereof in the CD direction is output.

Figure 10C:
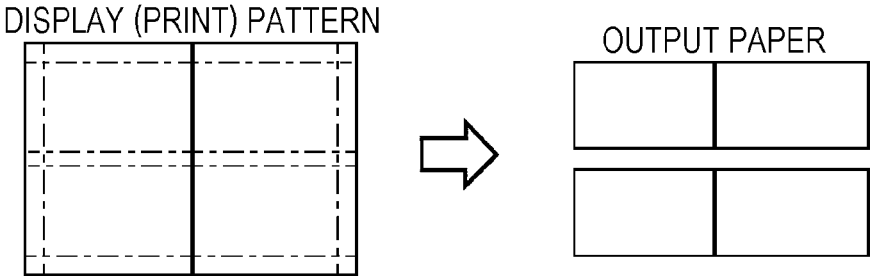
FIG. 10C is a schematic diagram illustrating an exemplary output of a paper post-processed by the first post-processing apparatus.

FIG. 10C is a diagram illustrating a case where, in addition to the four-side cutting and creasing, margin cutting slit processing by the margin cutting slit unit is performed. In this case, a paper the four edges of which are cut off and divided into two sheets in the FD direction with a streak formed in the CD direction is output.

Figure 10D:
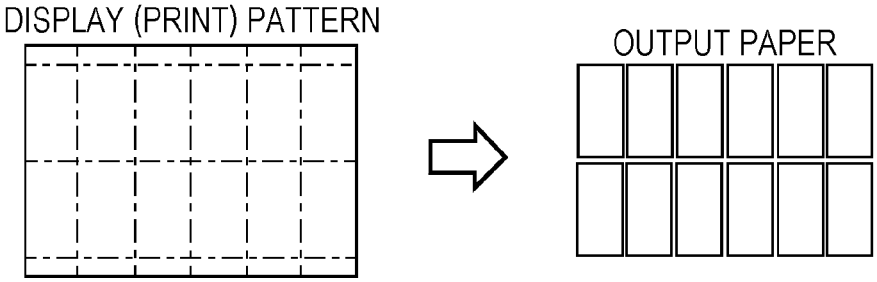
FIG. 10D is a schematic diagram illustrating an exemplary output of a paper post-processed by the first post-processing apparatus.

FIG. 10D is a diagram illustrating a case where FD slit processing and multiple cutting processing for business cards are performed. In this case, edges of the head and the tail are cut off, and papers divided into a plurality of sheets of the business card size is output.

Figure 10E:
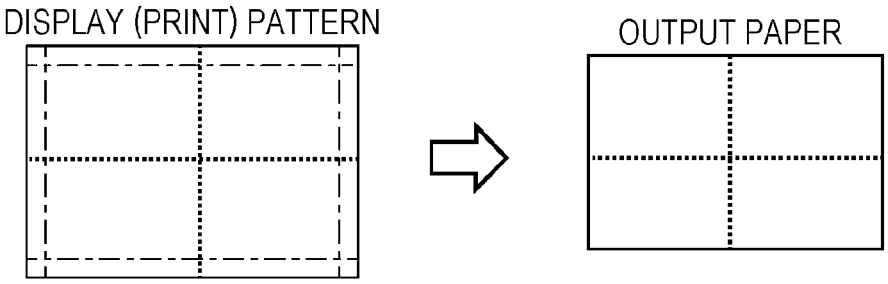
FIG. 10E is a schematic diagram illustrating an exemplary output of a paper post-processed by the first post-processing apparatus.

FIG. 10E is a diagram illustrating a case where four-side cutting processing, CD sewing processing, and FD sewing processing are performed. In this case, a paper the four edges of which are cut off with perforations formed in the CD direction and the FD direction is output.

<First Variation>

FIGS. 11A to 11D are schematic diagrams for explaining a first variation of the present embodiment. In the first variation, not only a post-processed paper 601 is presented but also the fact that post-processing is performed on the paper as appropriate depending on the arrangement of the functional units is presented to a user.

Figure 11A:
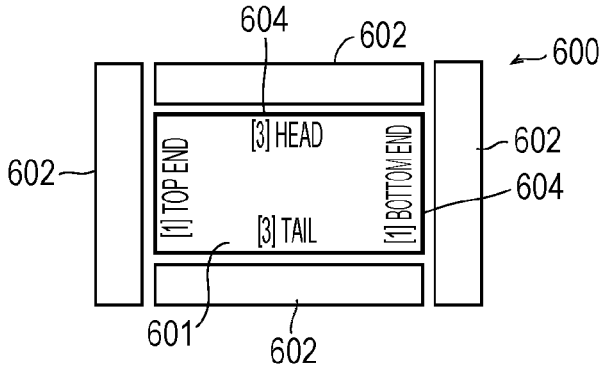
FIG. 11A is a schematic diagram for explaining a first variation.

As illustrated in FIG. 11A, a controller 360 adds texts 604 such as characters and numbers at cutting positions of a paper 600 in four-side cutting processing and thereby outputs the paper. In the example illustrated in FIG. 11A, "[1] top end" and "[1] bottom end" indicate the cutting positions at the top edge and the bottom edge, respectively, of the paper on which CD cutting processing is performed. "[3] Head" and "[3] tail" indicate the cutting positions at the edge of the head and the edge of the tail, respectively, on which FD slit processing is performed. Note that, as described above, the paper 601 the four edges of which have been cut off is presented to the user, but the removed four edges 602 are not presented to the user.

Figure 11B:
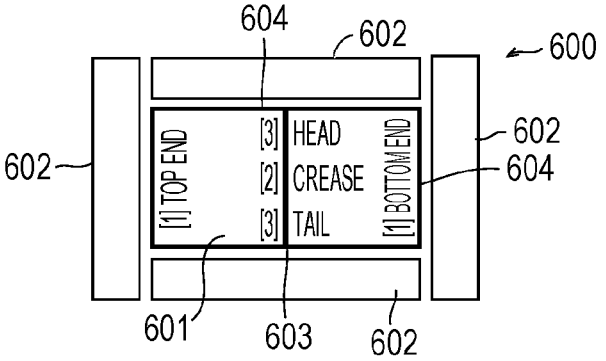
FIG. 11B is a schematic diagram for explaining the first variation.

As illustrated in FIG. 11B, in the case where crease processing is performed in addition to the four-side cutting processing of FIG. 11A, the controller 360 adds texts 604 such as characters and numbers at positions where a streak is formed and thereby outputs the paper. For example in the example illustrated in FIG. 11B, "[2] crease" indicates a position where a streak is formed.

Figure 11C:
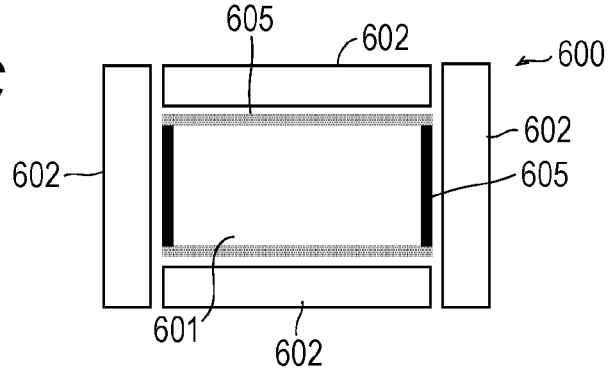
FIG. 11C is a schematic diagram for explaining the first variation.
Figure 11D:
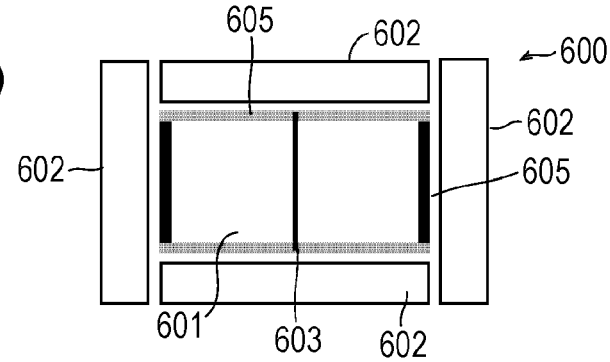
FIG. 11D is a schematic diagram for explaining the first variation.

Alternatively, instead of adding the texts 604 to the cutting positions of the paper 600, color frames 605 may be provided at the cutting positions as illustrated in FIGS. 11C and 11D. For example, a cutting position in the CD direction and a cutting position in the FD direction can be distinguished by coloring in different colors. Alternatively, different patterns, marks, designs, etc. may be applied to cutting positions in the CD direction and the FD direction to enable distinguishing the positions.

In this manner, since a picture of an output image including an identifier (text 604 or color frame 605) indicating a position at which a functional unit performs post-processing is printed in the first variation, a user can easily confirm that post-processing is appropriately performed on the paper that is actually output.

<Second Variation>

Figure 12A:
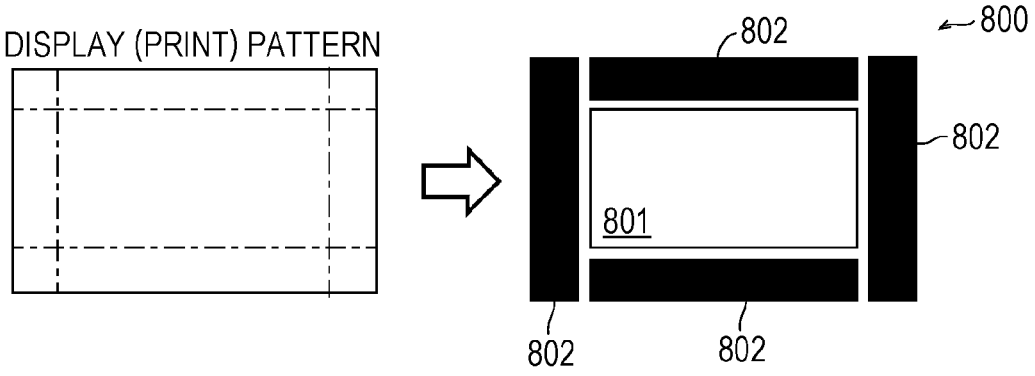
FIG. 12A is a schematic diagram for explaining a second variation.
Figure 12B:
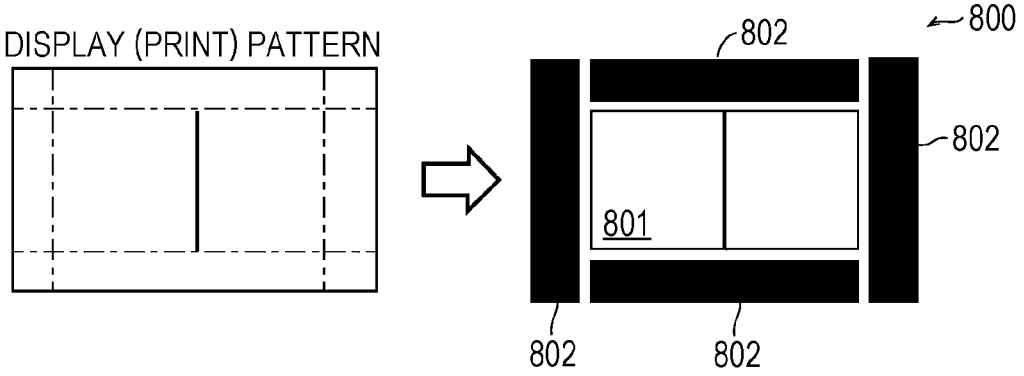
FIG. 12B is a schematic diagram for explaining the second variation.
Figure 12C:
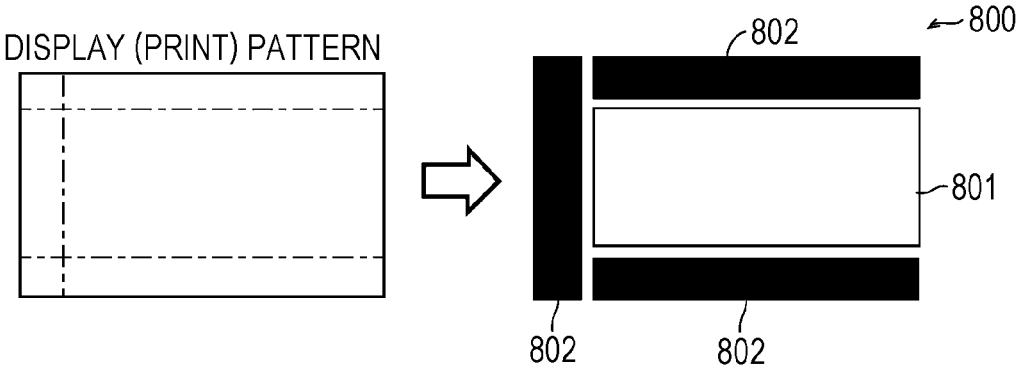
FIG. 12C is a schematic diagram for explaining the second variation.

FIGS. 12A to 12C are schematic diagrams for explaining a second variation of the present embodiment. In the second variation, by forming an image on not only a paper edges of which have been removed but also on the edges that have been removed by the cutting processing, the fact that the cutting processing is performed on the paper as appropriate depending on the arrangement of the functional units is presented to a user.

As illustrated in FIGS. 12A to 12C, a controller 360 forms a solid image on paper edges 802 to be removed by cutting processing of a paper 800. The paper edges 802 are peripheral parts adjacent to a picture of an output image, the peripheral parts excluding the picture of the output image. Note that it is unnecessary to form a solid image on the entire surface of the paper edges 802, and a frame line having a width of several millimeters surrounding the picture of the output image suffices. In the second variation, not only the paper 801 edges of which have been cut off but also the paper edges 802 are also presented to a user. The user confirms that no solid portion remains in the paper 801.

In this manner, since in the second variation an image is printed on adjacent regions surrounding the picture of the output image of the paper having been performed with cutting processing by the post-processor 320, the user can easily confirm that cutting processing is appropriately performed on the paper that is actually output.

The first post-processing apparatus 300 and the image forming system 100 of the present embodiment described above have the following effects.

Since the first post-processing apparatus 300 outputs conditions that allow post-processing depending on loading positions of functional units in the first post-processing apparatus 300, a user can easily determine whether desired post-processing can be performed.

<Third Variation>

Figure 13:
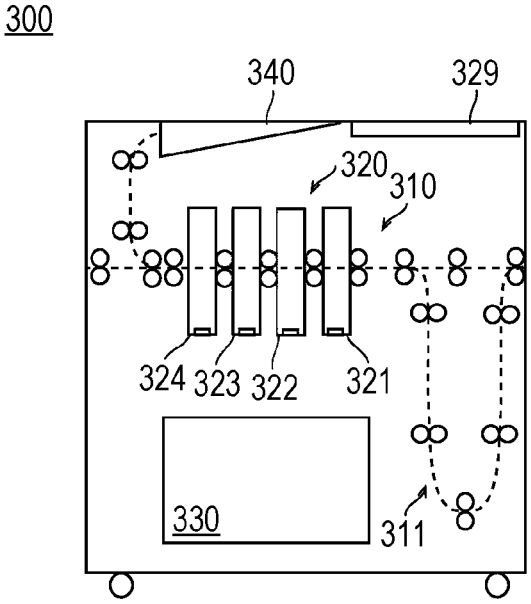
FIG. 13 is a cross-sectional view illustrating a schematic configuration of a first post-processing apparatus of a third variation.

FIG. 13 is a cross-sectional view illustrating a schematic configuration of a first post-processing apparatus 300 of a third variation. In the present variation, a case is described where, instead of the operation display 280 or the image former 230 of the image forming apparatus 200, a display 329 of a first post-processing apparatus 300 displays conditions that allow post-processing by a post-processor 320 and a picture of an output image.

The first post-processing apparatus 300 further includes the display 329. The display 329 functions as a condition output part together with a controller 360 and displays conditions that allow post-processing by the post-processor 320 depending on loading positions of functional units of the post-processor 320.

The embodiments have been described as the above. However, it is understood without mentioning that those skilled in the art can add, modify, and omit an embodiment of the present invention as appropriate within the scope of the technical idea of the present invention.

For example in the embodiment described above, the case has been described where the controller 360 of the first post-processing apparatus 300 derives conditions that allow post-processing by the post-processor 320 depending on loading positions of functional units detected by the detection sensors 325 to 328. However, the present invention is not limited to such a case, and the controller 290 of the image forming apparatus 200 may derive conditions that allow post-processing by the post-processor 320 depending on loading positions of functional units detected by the detection sensors 325 to 328.

Moreover, in the embodiment described above, the case where a paper being post-processed in the first post-processing apparatus 300 is pulled by the second post-processing apparatus 400 connected in a later stage has been described as the constraint for example; however, the present invention can also be applied to other constraints. Furthermore, the present invention can be applied not only to constraints related to the CD direction but also to constraints related to the FD direction.

Meanwhile, the control programs of the image forming apparatus, the first and second post-processing apparatuses may be provided by a computer readable recording medium such as a USB memory, a flexible disk, and a CD-ROM or may be provided online via a network such as the Internet. In this case, the program recorded in the computer-readable recording medium is usually transferred to and stored in a storage, a storage device, or the like. This control program may be provided as independent application software, for example, or may be incorporated into software of each device as one function of the image forming apparatus.

Although embodiments of the present invention have been described and illustrated in detail, the disclosed embodiments are made for purposes of illustration and example only and not limitation. The scope of the present invention should be interpreted by terms of the appended claims.

What is claimed is:

1. A post-processing apparatus that performs, by one or more functional units which can be switched one another, predetermined post-processing corresponding to a function of the one or more functional units on a conveyed paper, the post-processing apparatus comprising:

a plurality of slots in which the one or more functional units can be loaded at respective loading positions along a conveyance path; and a hardware processor that detects that the one or more functional units are loaded in the slots and outputs a condition that allows the post-processing depending on a conveyance state of the conveyed paper based on the loading positions of the slots in which the one or more functional units are loaded.

2. The post-processing apparatus according to claim 1, wherein the hardware processor detects a type of the function of the one or more functional units loaded in the slots, and outputs the condition depending on the type of the function detected by the hardware processor and the loading positions.

3. The post-processing apparatus according to claim 1, wherein the hardware processor outputs the condition in a case where the one or more functional units loaded in the slots perform post-processing in a direction orthogonal to a paper conveyance direction on the paper.

4. The post-processing apparatus according to claim 1, wherein the hardware processor outputs a list of the condition corresponding to the loading positions of the one or more functional units for a combination of the plurality of functional units.

5. The post-processing apparatus according to claim 1 in combination with an image former in an image forming system, wherein the image former that forms an image on a paper; and the post-processing apparatus performs post-processing on the paper.

6. The post processing apparatus according to claim 5, wherein the hardware processor controls and causes the image former to print a picture of an output image including an identifier indicating a position at which the one or more functional units at the loading positions perform post-processing.

7. The post processing apparatus according to claim 5, wherein the hardware processor controls and causes the image former to print an image in a peripheral part adjacent to a picture of an output image, the peripheral part obtained by excluding the picture of the output image of the paper after the one or more functional units have performed cutting processing as the post-processing.

8. The post-processing apparatus according to claim 1, wherein the condition relates to a limit with respect to a position on the conveyed paper at which a function of the one or functional units can be performed.

9. The post-processing apparatus according to claim 1, wherein the hardware processor determines whether constraints are posed by the loading positions of the slots in which the one or more functional units are loaded.

10. The post-processing apparatus according to claim 1, wherein the conveyance state of the conveyed paper relates to whether the conveyed paper is drawn by a conveyor downstream of the one or more functional units while the one or more functional units performs the predetermined post-processing.

11. A non-transitory recording medium storing a computer readable control program of a post-processing apparatus that comprises a plurality of slots in which one or more functional units can be loaded at respective loading positions along a conveyance path and performs, by the one or more functional units which can be switched one another, predetermined post-processing corresponding to a function of the one or more functional units on a conveyed paper, the control program causing a computer to perform:

(a) detecting that the one or more functional units are loaded in the slots; and (b) outputting a condition that allows the post-processing apparatus to perform the post-processing depending on a conveyed state of the conveyed paper based on the loading positions, where the one or more functional units are loaded, detected in the (a).

12. A post-processing apparatus that performs, by one or more functional units which can be switched one another, predetermined post-processing corresponding to a function of the one or more functional units on a conveyed paper, the post-processing apparatus comprising:

a plurality of slots in which the one or more functional units can be loaded at respective loading positions along a conveyance path; and a hardware processor that detects that the one or more functional units are loaded in the slots and outputs a condition that allows the post-processing depending on the loading positions of the slots in which the one or more functional units are loaded, wherein the condition relates to a limit with respect to a position on the conveyed paper at which a function of the one or functional units can be performed.

13. A post-processing apparatus in combination with an image former in an image forming system, wherein the image former forms an image on a paper and the post-processing apparatus performs, by one or more functional units which can be switched one another, predetermined post-processing corresponding to a function of the one or more functional units on a conveyed paper, the post-processing apparatus comprising:

a plurality of slots in which the one or more functional units can be loaded at respective loading positions along a conveyance path; and a hardware processor that detects that the one or more functional units are loaded in the slots and outputs a condition that allows the post-processing depending on the loading positions of the slots in which the one or more functional units are loaded, wherein the hardware processor controls and causes the image former to print a picture of an output image including an identifier indicating a position at which the one or more functional units at the loading positions perform post-processing.

* * * * *